US006418570B1

(12) United States Patent
Ball

(10) Patent No.: US 6,418,570 B1
(45) Date of Patent: Jul. 16, 2002

(54) DRAIN CLOSURE

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 09/825,812

(22) Filed: Apr. 4, 2001

(51) Int. Cl.[7] ..... A47K 1/14
(52) U.S. Cl. ..... 4/295
(58) Field of Search ..... 4/286, 287, 295

(56) References Cited

U.S. PATENT DOCUMENTS

| | | | |
|---|---|---|---|
| 4,720,877 | A | 1/1988 | Watts |
| 4,908,883 | A | 3/1990 | Rivera |
| 4,926,507 | A | 5/1990 | Craig et al. |
| 5,072,461 | A | 12/1991 | Logsdon |
| 5,428,847 | A | 7/1995 | Atkins et al. |
| 5,749,105 | A | 5/1998 | Bruno et al. |
| 5,758,368 | A | 6/1998 | Ball |
| 5,832,545 | A | 11/1998 | Pan |
| 5,881,397 | A | 3/1999 | Hobbs |
| 6,067,669 | A | 5/2000 | Peterson et al. |
| 6,138,290 | A | 10/2000 | Lin |

FOREIGN PATENT DOCUMENTS

| | | | |
|---|---|---|---|
| CA | 1197653 | * 12/1985 | ..... 4/286 |

* cited by examiner

*Primary Examiner*—Charles E. Phillips

(57) ABSTRACT

A drain closure that maintains a stopper in any open position by force exerted by the post against the internal surface of the bore of the stopper. The post has ridges that extend outwardly from the outer surface of the post. The post also has an open elongated slot that extends through the post. When the post is received in the bore of the stopper the ridges are compressed toward the open slot and expand outwardly against the bore to maintain the stopper in place.

6 Claims, 3 Drawing Sheets

DRAIN CLOSURE

BACKGROUND OF THE INVENTION

This invention relates to drain closures for use with bathtubs, sinks, laundry tubs, and the like, and more particularly to drain closures that are maintained in any open position by force exerted by the post on the stopper.

While there are a variety of drain closures, U.S. Pat. No. 4,720,877 describes a drain closure that uses an interrupted metal ring fitted in a groove on a post that is compressed in a bore of a stopper and expands to exert a force to hold the stopper in an open position. While this device provides the advantage of maintaining the stopper in any open position, the device requires multiple parts and machining. Likewise, in some situations during operation, the ring can become dislodged from the groove causing the stopper to stick or jam.

Therefore, a primary objective of the present invention is to provide a drain closure that is simple to manufacture and utilizes a minimum number of parts.

A further objective of the present invention is to provide a drain closure having an integrally molded resilient post that exerts a force to hold the stopper in any position.

Yet a further objective of the invention is to provide a drain closure that is economical to manufacture.

BRIEF SUMMARY OF THE INVENTION

In accordance with the invention the drain closure has a strainer body, and a resilient post that is mounted in a vertical bore of the strainer body. On the outer surface of the post are protruding ridges that extend outwardly from the outer surface of the post. The post also has an elongated open slot that extends through the post. A stopper is mounted on the post and is slidably moveable thereon. The stopper has a bore that receives the post such that the ridges on the post are compressed toward the open slot and expand outwardly against the bore of the stopper to exert a force which maintains the stopper in any position moved thereto.

DETAILED DESCRIPTION OF THE INVENTION

Figure 1:
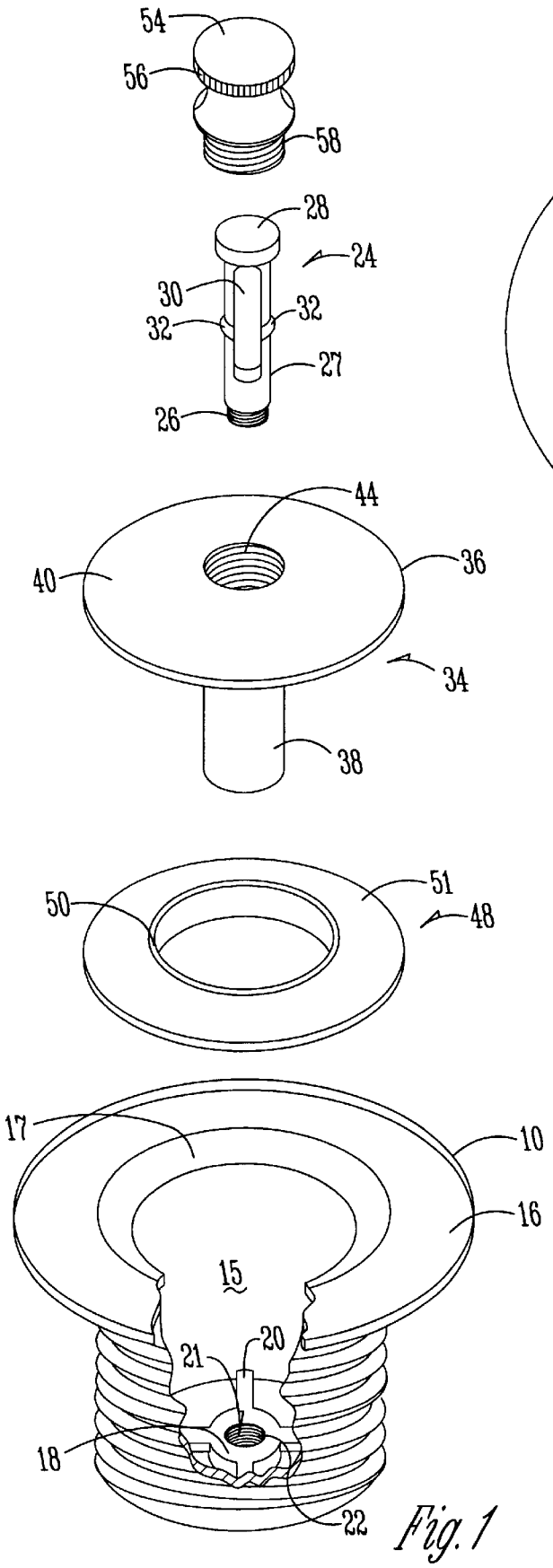
FIG. 1 is a exploded perspective view of the drain closure.
Figure 2:
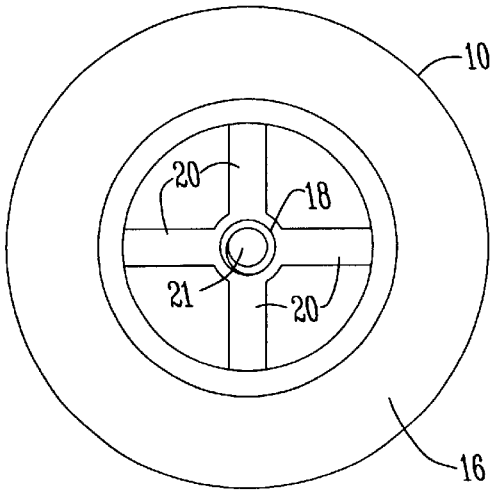
FIG. 2 is a top plan view of the strainer body.

Referring now to the drawing in detail, the numeral 10 generally designates a strainer body having a cylindrical wall 12 which is externally threaded at 14 in order to thread into a drain fitting under the floor of a bathtub (or a sink, laundry tub or other drain opening). Within the strainer body 10, a drain passage 15 is provided for draining of liquid from the tub. The top edge of the strainer body 10 is provided with an annular flange 16. The top or entry to passage 15 is tapered or beveled as indicated by numeral 17. Formed within the lower portion of the strainer body is a ring 18 carried on a spider 20 secured to the inside surface of the wall 12. The ring 18 is concentric with the wall 12. Extending through the ring 18 is a bore 21 that has internal threads 22.

Mounted within the strainer body 10 is a post 24 having male threads 26 on its bottom end that mate with the female threads 22 of ring 18. The post 24 can thus be threaded into ring 18 and is mounted in this manner to extend along the central axis of the strainer body. The post 24 can be made of any resilient material, however in the preferred embodiment a hard polypropylene plastic is preferred. The post 24 has a shank 27 and a head 28 that is enlarged in diameter compared to the shank 27. The post 24 has an open elongated vertical slot 30 that extends laterally through the post 24. Extending outwardly from the post are ridges 32. The ridges 32 can be secured to the post 24 by any conventional means however in the preferred embodiment the ridges are integrally molded as part of the post.

Figure 3:
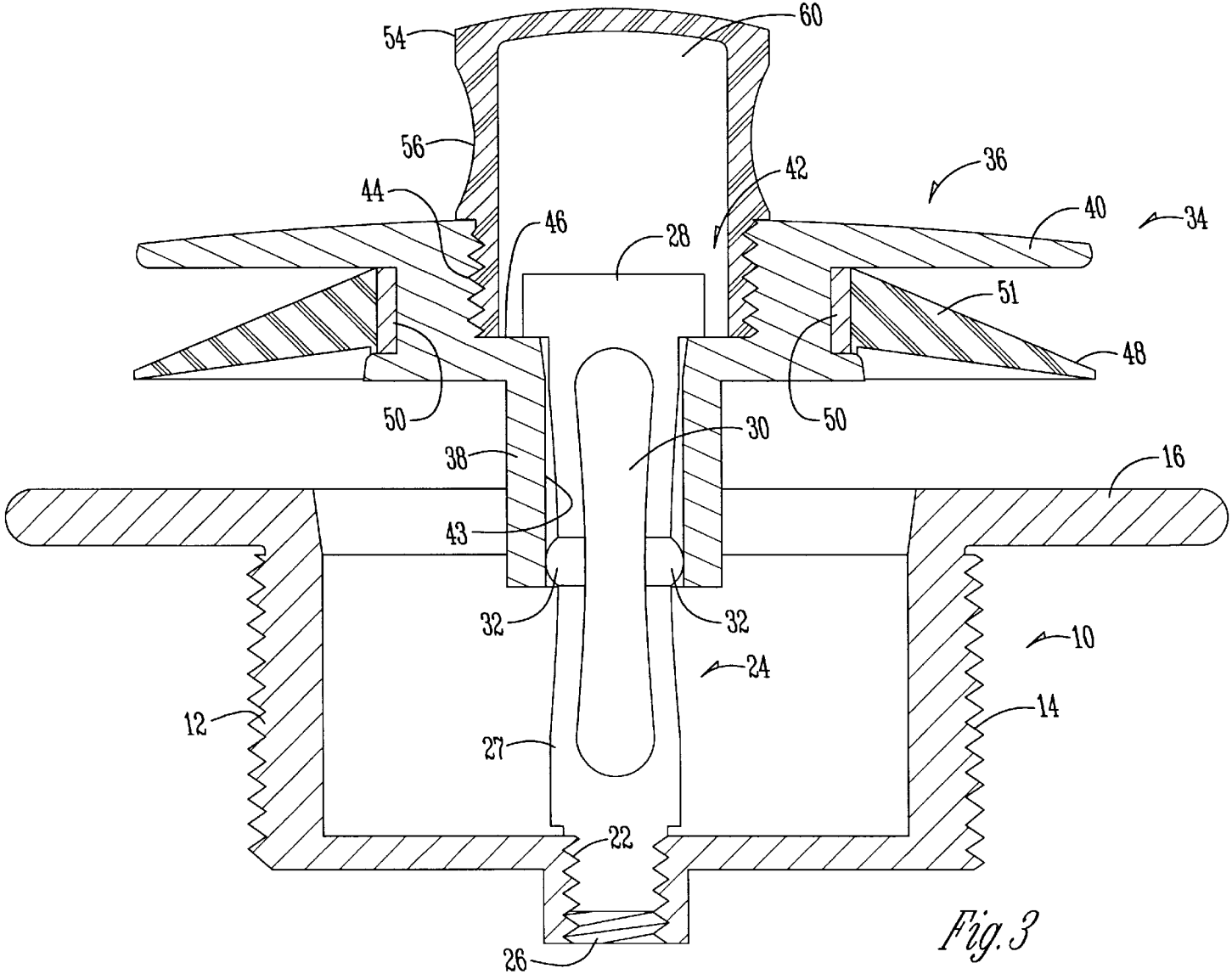
FIG. 3 is a large scale vertical sectional view of the drain closure in an open position.
Figure 4:
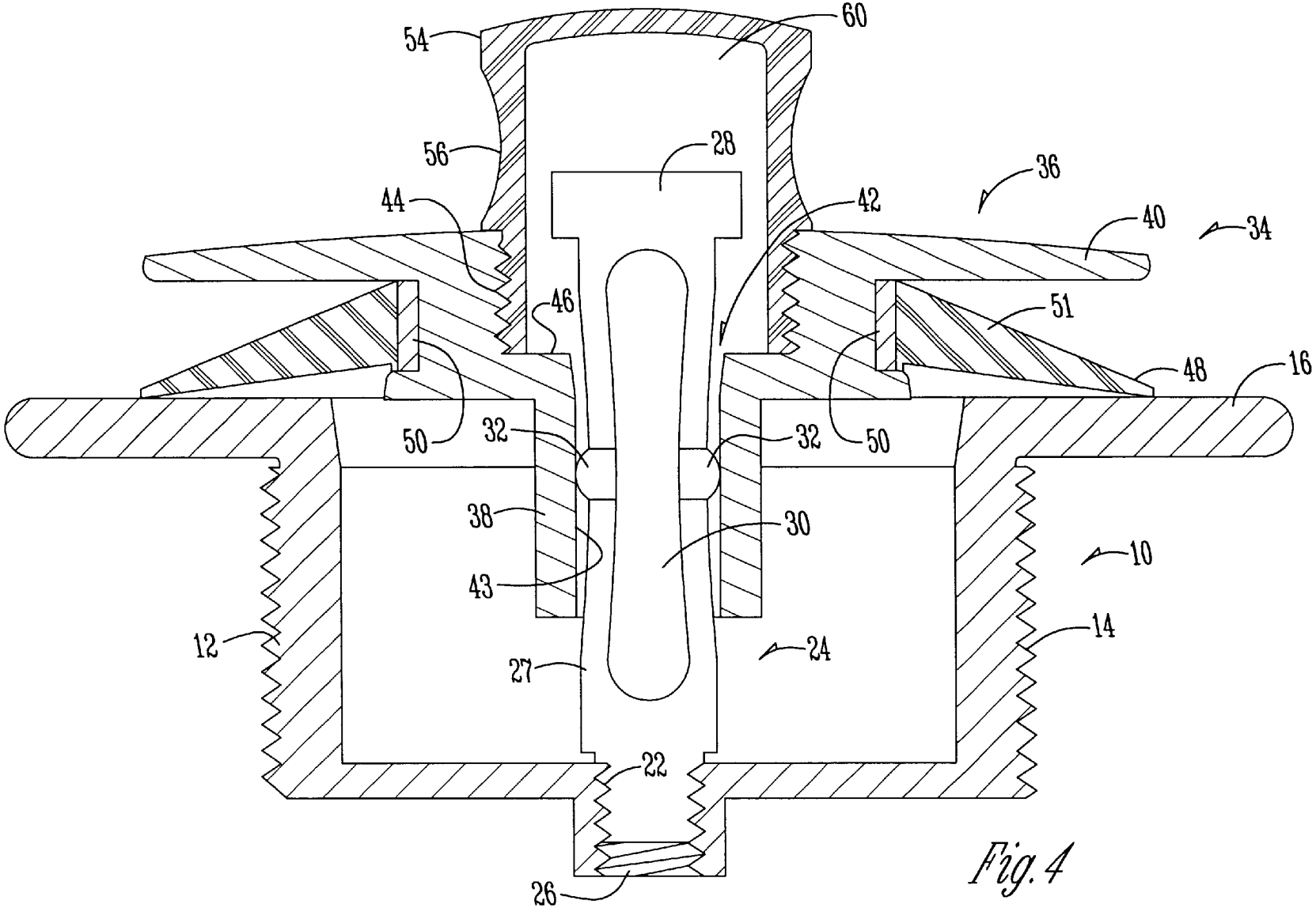
FIG. 4 is a sectional view of similar to that of FIG. 3 but with the drain closure in a closed position.

Fitted on post 24 is a stopper 34 having a disk-shaped head 36 and a sleeve 38 projecting from its lower surface. The head 36 has an enlarged flange 40 forming its top surface. A bore 42 (FIG. 3) is formed centrally through the stopper 34. The bore is surrounded by an internal surface 43 of the stopper. The upper portion of the bore 42, within head 36, is larger than the remainder of the bore and is internally threaded at 44. An upwardly facing shoulder 46 is formed within the bore at the lower end of the threaded portion 44 where it intersects with the bore surface 43.

The stopper head 36 is larger in diameter than the drain passage 15 provided within the strainer body 10. A flapper type gasket 48 includes a ring portion 50 which fits closely on the outer edge of the stopper head at a location immediately below the flange 40. The gasket 48 also includes a rim portion 51 which projects generally outwardly from the ring portion 50. In this natural condition, the rim 51 has a frusto-conical shape. When the stopper 34 is in a closed position, the rim 51 is pressed flat against the strainer body flange 16 by the stopper flange 40 to form a tight seal which closes the drain passage 15. In any open position the stopper head 36 and flapper 48 are displaced above the top of the strainer body, and the drain is then opened for drainage of liquid from the bathtub or other vessel equipped with the drain closure.

It should be understood that the flapper 48 is optional and is not necessary for a satisfactory seal, although it does provide some added protection against leakage. The stopper may instead be equipped with an O-ring or another type of sealing element, or it may be constructed to seal the drain passage without any separate sealing element at all. The closure of the present invention does not depend on any particular seal to work effectively.

The bore 42 has a slightly larger diameter than the post 24, and the stopper 34 is received on post 24 for up and down sliding movement thereon. At the same time, the close fit of bore 42 on post 24 prevents the stopper assembly from wobbling. In addition, the fit of post 24 in bore 42 permits the stopper 34 to turn about the axis of the vertical post 24. When stopper 34 is fitted on post 24, the internal stopper surface 43 compresses the ridges 32 toward the open slot 30. The internal outward force of the compressed slot 30 causes the ridges 32 to expand outwardly against the surface 43 of the stopper 34, thereby exerting a force between the post and the stopper.

In assembling the drain closure, the stopper 34 is applied to the bottom end of post 24, and the enlarged head 28 of the post is able to enter the threaded area 44 but not the smaller main portion of bore 42. The ridges 32 engage the internal surface 43 of bore 42, thus causing slot 30 to deflect in an inwardly direction whereupon ridges 32 are forced outwardly against the surface 43. The head 28 contacts shoulder 46 to prevent the stopper from being lifted off the top of post 24.

The upper end of bore 42 is closed by a knob 54 having a knurled exterior surface 56. The lower end of the knob is externally threaded 58 in order to mate with the internal threads 44 formed in the upper portion of bore 42. When the knob 54 is threaded into the stopper head it closes the top end of bore 42 and encloses the head 28 of the post. Extending upwardly into knob 54 is an internal blind passage 60 having a slightly larger diameter than the post head 28. The head 28 of post 24 is accommodated within passage 60. Knob 54 facilitates lifting the stopper.

The drain closure is installed by first applying the stopper 34 to the post 24 and then threading the lower end of the post into ring 18 of the strainer body 10. The knob 54 is then threaded onto the top of the stopper to complete the installation.

In use of the drain closure, the stopper 34 can be moved to the closed position simply by pressing downwardly with hand or foot on the stopper or knob 54. The stopper then slides downwardly until the flapper 48 is flattened and seals tightly against the flange 16 of the strainer body. In addition to the weight of the stopper assembly, the force provided by the ridges 32, as described above, helps to retain the stopper in the closed position, thereby enhancing its effectiveness in preventing leakage.

It should be noted that the foot or hand pressure can be applied to any portion of the stopper assembly at virtually any angle and without the need for undue force. The only force that needs to be overcome to move the stopper assembly downwardly is the force provided by the ridges 32 bearing against the internal surface 43 of the bore 42. When this is done, surface 43 will thereupon slide over ridge 32.

To open the drain closure to any position, knob 54 is grasped and lifted upwardly to raise the stopper assembly to any open position. When the stopper assembly has been raised to an open position, it can be released and the force provided by the ridges 32 expanding against the surface 43 retains the stopper in an open position. The ridges 32 which are compressed toward the open slot 30 expand outwardly with sufficient force to provide a frictional force between the ridges and the stopper that is greater than the weight of the stopper assembly. Accordingly, the weight of the stopper is insufficient to lower the stopper from any open position, and it is maintained in an open position until again moved by hand or foot to the closed position. The force applied by the ridges 32 is the sole force holding the stopper in an open position, and it can be overcome by pushing downwardly with a hand or foot. In a preferred embodiment the ridges 32 are maintained at all times under virtually the same amount of compression and the ridges are not stretched and compressed each time a unit is cycled between any open and closed position. Consequently, the post is not subject to fatigue or other failure due to cycling, and it can continue to maintain substantially the same force against surface 43 virtually indefinitely. Also noted is the ability of the stopper assembly to rotate on post 24 which minimizes the wear of the ridges on the stopper surface 43 and avoids the formation of grooves therein.

Apparent from this description is a unique drain closure that incorporates new desirable features and avoids the disadvantages of other drain closures. The construction is simple and reliable in comparison to other drain closures and yet takes full advantage of the desirable feature of providing force from the post to maintain the stopper in any open position. There is no tendency for the stopper assembly to stick or jam.

From the foregoing, it will be seen that this invention is one well adapted to attain all the ends and objectives hereinabove set forth with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A drain closure device comprising:

a strainer body having a threaded vertical bore therethrough;

an elongated cylindrical post comprised of resilient material threadingly mounted in the vertical bore of the strainer body, the post having a vertically elongated slot extending laterally therethrough along a central longitudinal axis of the post;

a pair of opposing resilient annular ridges rigidly secured on a diameter or circumferential surface of the post laterally adjacent to the slot so as to protrude radially outward from the diameter of the post to define an effective diameter; and a stopper having a cylindrical vertical bore for slidably receiving the post, the bore having a diameter slightly larger than the diameter of the post and slightly smaller than the effective diameter at the ridges so that the ridges frictionally engage the stopper at the bore and are urged radially inward toward the slot such that the resilient material of the post around the slot responds by exerting substantially constant outward forces on the ridges to maintain the stopper in any position moved thereto along the post even when the post and stopper are rotated relative to each other.

2. The device of claim 1 wherein the bore of the stopper has a lead-in chamfer at an entrance thereof for guiding the post and the ridges into the bore.

3. The device of claim 2 wherein the ridges are integrally molded on the circumferential surface of the post.

4. The device of claim 3 wherein the ridges are integrally molded on the circumferential surface at a single common location along the length of the post.

5. The device of claim 2 wherein ridges have an arcuate outer edge in a vertical plane that includes the central longitudinal axis of the post.

6. The device of claim 5 wherein the ridges have an arcuate outer edge in a horizontal plane perpendicular to the central longitudinal axis of the post.

* * * * *

UNITED STATES PATENT AND TRADEMARK OFFICE

CERTIFICATE OF CORRECTION

PATENT NO. : 6,418,570 B1
DATED : July 16, 2002
INVENTOR(S) : William T. Ball

It is certified that error appears in the above-identified patent and that said Letters Patent is hereby corrected as shown below:

Column 4,
Line 49, delete the numeral "2" and insert the numeral -- 1 --.
Line 54, delete the numeral "2" and insert the numeral -- 1 --.

Signed and Sealed this

Seventeenth Day of December, 2002

JAMES E. ROGAN
*Director of the United States Patent and Trademark Office*